US005373339A

United States Patent [19]

Greene et al.

[11] Patent Number: 5,373,339

[45] Date of Patent: Dec. 13, 1994

[54] APPARATUS AND METHOD FOR SEPARATING SPLICED STRIPS OF PHOTOGRAPHIC FILM

[75] Inventors: William J. Greene, Webster; John A. Romansky, Hilton; Randall R. Maysick, Churchville, all of N.Y.

[73] Assignee: Eastman Kodak Company, Rochester, N.Y.

[21] Appl. No.: 171,950

[22] Filed: Dec. 22, 1993

[51] Int. Cl.[5] ..... G03D 3/02

[52] U.S. Cl. ..... 354/354

[58] Field of Search ..... 354/247, 354; 242/74; 226/91, 92

[56] References Cited

U.S. PATENT DOCUMENTS

| | | | |
|---|---|---|---|
| T889,025 | 8/1971 | Ulmschneider et al. | 156/344 |
| T947,009 | 6/1976 | Ammons | 156/344 |
| 1,389,523 | 8/1921 | Mercer . | |
| 1,655,297 | 1/1928 | Thornton . | |
| 2,176,507 | 10/1939 | Nagel . | |
| 2,433,446 | 12/1947 | Foster . | |
| 2,508,243 | 5/1950 | Foster . | |
| 2,585,226 | 2/1952 | Christman | 242/74 |
| 2,590,678 | 3/1952 | Caim . | |
| 2,679,969 | 6/1954 | Richter . | |
| 2,900,868 | 8/1959 | Gaffney, Jr. . | |
| 3,021,055 | 2/1962 | Chall et al. . | |
| 3,022,170 | 2/1962 | Flinchbaugh et al. | 242/74 |
| 3,169,722 | 2/1965 | Bartles et al. . | |
| 3,196,034 | 7/1965 | Pandolfo III . | |
| 3,348,640 | 10/1967 | Thompson et al. . | |
| 3,405,882 | 10/1968 | Bottani . | |
| 3,503,568 | 3/1970 | Galley . | |
| 4,339,295 | 7/1982 | Boretos et al. . | |
| 4,715,920 | 12/1987 | Ruppman et al. | 156/344 |
| 4,755,550 | 7/1988 | Shuman et al. | 156/344 X |
| 5,154,793 | 10/1992 | Wojnarowski et al. | 156/344 |
| 5,230,479 | 7/1993 | Ritchie | 242/74 |

FOREIGN PATENT DOCUMENTS

| | | |
|---|---|---|
| 4-116653 | 4/1992 | Japan . |
| 4-121744 | 4/1992 | Japan . |
| 4-125554 | 4/1992 | Japan . |
| 4-257856 | 9/1992 | Japan . |

*Primary Examiner*—D. Rutledge

*Attorney, Agent, or Firm*—J. Addison Mathews

[57] ABSTRACT

Apparatus and methods are provided for separating photographic film strips, adhered to a splice, by restricting movement of the splice and then pulling the film strips longitudinally in opposite directions. According to one feature, the splice adhesive is heated until it softens, preferably with a hot shoe applied against the splice under pressure. According to other features a space is left between the ends of the film strips when they are spliced together, and the splice is engaged from both sides while the film strips are pulled apart. Still more specifically, according to another aspect of the invention, a carrier or splice pick-up web is provided for removing the splices from the area and for holding the removed splices in a manner particularly convenient for disposal.

18 Claims, 4 Drawing Sheets

APPARATUS AND METHOD FOR SEPARATING SPLICED STRIPS OF PHOTOGRAPHIC FILM

CROSS-REFERENCE TO RELATED APPLICATIONS

Reference is made to commonly assigned copending U.S. patent application entitled FILM PROCESSING SYSTEM, (Ser. No. 08/171,582) and filed on Dec. 22, 1993, the disclosure of which hereby is incorporated into the present specification.

BACKGROUND OF THE INVENTION

1. Field of Invention

The invention relates to photography, and the removal of splices from the ends of film strips. More specifically the invention relates to the non-destructive separation of film strips from splices with the ends of the film strips intact.

2. Description of the Prior Art

Typically exposed photographic film is spliced together for development and printing to facilitate handling of the film in automated equipment. Individual film rolls are removed from their containers, usually called cartridges, and the resulting film strips are coupled together end-to-end with splices. The coupled strips form a long ribbon that is threaded and follows a sinuous path through processing equipment, into and out of developing solutions and drying chambers. Most of the processing steps are completed in the dark.

Such rough handling, and the severe consequences of a break, require a secure attachment at every splice. The splices include a tough paper or plastic backing coated with a thermal adhesive. Usually the splices are applied to the film strips with heat and pressure.

After processing, the film is cut to remove the splices and again divide the ribbon into shorter film strips that correspond in some whole number of strips to each original order. This is anticipated during film manufacture, when leaders and trailers at the ends of the film strips are provided with extra material.

More recent developments include alternate approaches in which the film strips are returned after processing to a cartridge similar to the cartridge in which they were exposed. The splice is still removed by cutting, but the cut film strip is then reinserted into the cartridge for return to the customer.

PROBLEM SOLVED BY THE INVENTION

Although cutting is a simple approach for removing splices, obviously it damages and shortens the film compared to its manufactured state.

Film strips frequently have a special configuration at their leading and/or trailing ends. At the trailing end the shape facilitates attachment of the film to a spool inside the cartridge. At the leading end the shape reduces friction at the cartridge exit. When the film is cut, the configuration and its accompanying features either are lost, or must be included in the cutting die.

Film strips typically are manufactured with extra material to accommodate splice removal during processing. Again the approach is simple, but adds material expense, including silver, a precious metal. This material then must be disposed of after processing. The amounts are small when compared to a single film strip, but build up at the photofinishing level. Silver is a heavy metal that requires special disposal procedures.

SUMMARY OF THE INVENTION

The present invention is directed to overcoming one or more of the above-mentioned and other problems associated with the prior art. Briefly summarized, according to one aspect of the invention, apparatus and methods are provided for separating photographic film strips adhered to a splice by restricting movement of the splice and then pulling the film strips longitudinally in opposite directions. According to one feature, the splice adhesive is heated until it softens, preferably with a hot shoe applied against the splice under pressure. According to other features a space is maintained between the ends of the film strips when they are spliced together, and the splice is engaged from both sides while the film strips are pulled apart. Still more specifically, according to alternative features, the hot shoe is opposed by a platen supported for relative movement toward and away from the shoe, and is mounted to float for alignment when they come together. The platen includes a rod supported for rotation, both to increase the pressure against the splice through a reduced area of contact and to facilitate longitudinal movement of the film and splice.

According to another aspect of the invention, a carrier or splice pick-up web is provided for removing the splices from the area and for holding the removed splices in a manner particularly convenient for disposal. The adhesive remaining on the splice is used to adhere the splice to the web.

ADVANTAGEOUS EFFECTS OF THE INVENTION

The invention removes splices from film strips non-destructively, so the leading and trailing ends of the film strips remain intact. No extra film length is required to accommodate cutting, waste is reduced, and the original configuration is retained. Reorders and makeovers all can be handled in the same manner, again without shortening the film each time.

The invention has particular utility when the film is reloaded into its cartridge after processing. The trailing end still includes the configuration and dimensions originally provided for attachment to the cartridge spool, and the leading end likewise still includes the features facilitating movement of the film through the exit.

These and other features and advantages will be more clearly understood and appreciated from a review of the following detailed description of the preferred embodiments and appended claims, and by reference to the accompanying drawings.

DESCRIPTION OF THE PREFERRED EMBODIMENTS

Figure 1:
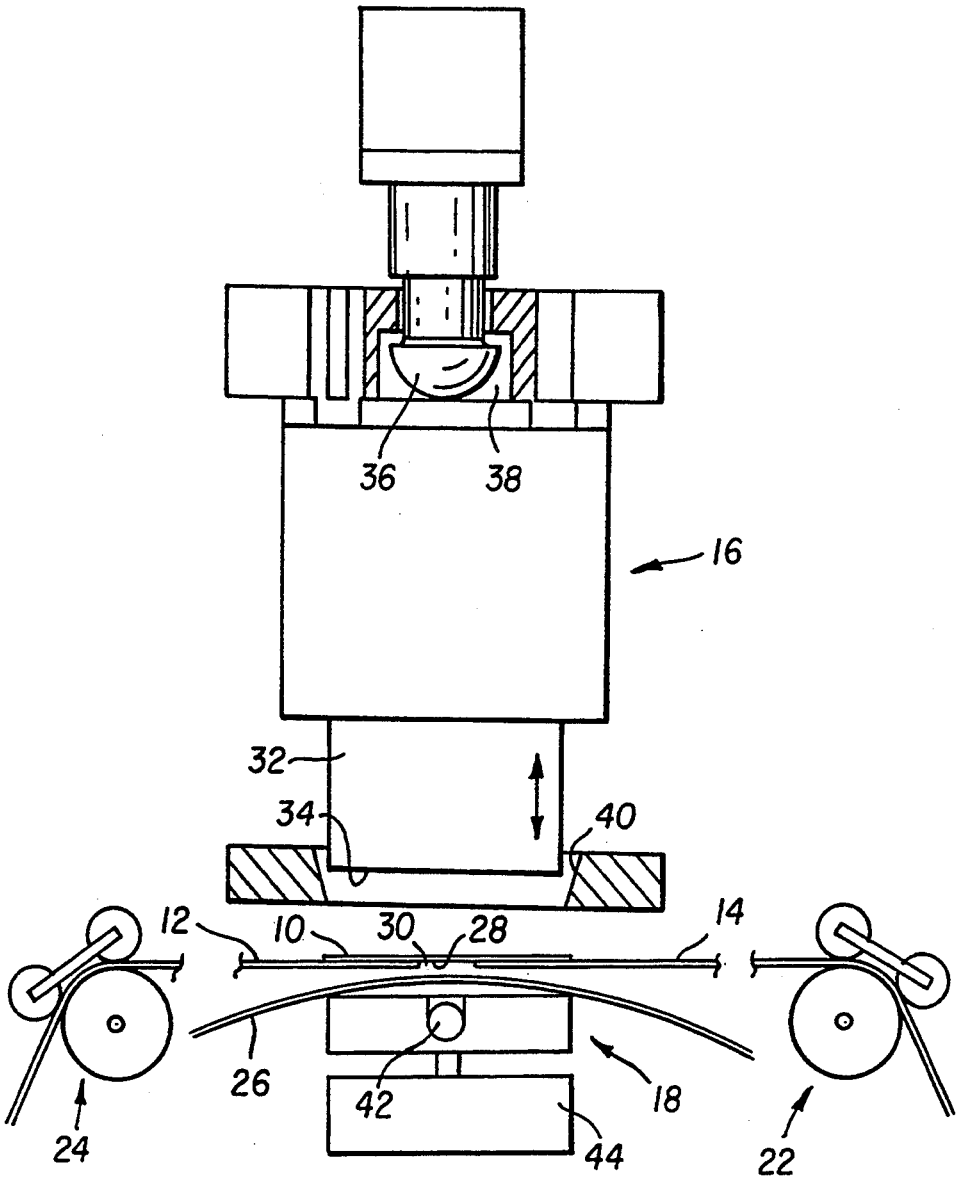
FIG. 1 is a schematic view of desplicing apparatus, according to a preferred embodiment of the invention, including a hot shoe for softening the splice adhesive and an opposed platen for supporting the splice against the shoe.
Figure 2:
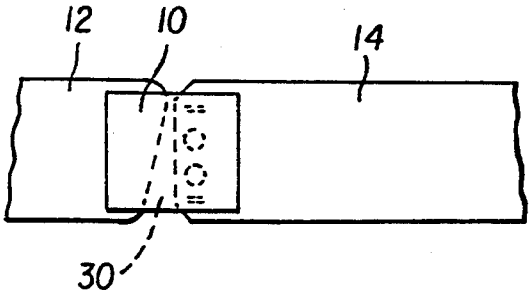
FIGS. 2 and 3 are top views of leading and trailing ends of film strips spliced together in FIG. 2 and with the splice removed in FIG. 3.

Referring now to FIGS. 1–4, a preferred embodiment of desplicing apparatus is depicted for removing splices 10 (FIG. 2) from the leading and trailing ends of two film strips 12 and 14, respectively. The apparatus includes: a) a heating head 16 and opposed platen 18, that move one relative to the other for capturing and heating the splice 10; b) first and second drives 22 (FIG. 4) and 24, for transporting the film strips in the apparatus and for pulling the strips apart from the heated splice; and, c) a disposable splice pick-up web 26 that advances to carry the removed splices away for subsequent disposal.

Splice 10 is typical of products used by the photofinishing industry today and includes treated paper with a layer of thermal adhesive 28 on one surface. Examples of such adhesives include Buna S, a poly(styrene-cobutadiene), and Buna N, a poly(acrylonitrile-cobutadiene), both widely available to the industry under a number of trade names. The splice 10 is applied to the film strips 12 and 14 with heat and pressure. The film strips thus are coupled securely together with a longitudinal spacing 30 of approximately three millimeters (3 mm), between the strips for purposes to be described hereinafter. The adhesive in this preferred embodiment is thermoplastic and will soften beginning at approximately one hundred and twenty degrees Celsius (120° C.).

Head 16 includes a heating shoe 32, ending in a hot plate 34 that is substantially flat, with a bottom area slightly greater than the dimensions of the splice, to heat the splice uniformly. The shoe 32 reciprocates in the head between a raised position removed from the platen and a lowered position where it will engage a splice supported on the platen. The head 16 is supported to float on a ball and socket 36 and 38, or similar arrangement, so it will align itself to the platen in the lowered position. Rough initial alignment is assisted by a ramped structure 40.

The head preferably is biased toward the raised position and is moved with air pressure to the lowered position to exert a pressure on the splice 10 of approximately five hundred and seventy five killo-pascals (575 kpa). The temperature of the hot plate 34 is approximately one hundred and seventy degrees centigrade (170° C.), and the dwell time for heating the splice adhesive is approximately one and three tenths seconds (1.3 s).

Platen 18 is an insulator, preferrably a phenolic material, that remains stationary to counter the force applied by hot shoe 32. Included in the platen 18, however, is an elongate pressure rod 42, having a diameter of approximately four and seventy six one hundredths millimeters (4.76 mm), that is supported for both rotation and reciprocation perpendicular to the splice or toward the hot shoe 32. Reciprocation is provided under pressure from an air supply 44 sufficient to overcome the opposed pressure from the hot shoe 32 and raise the shoe slightly away from the platen 18. Raising the hot shoe 32 relieves some of the pressure on the film strips so they can be pulled more easily from the splice, as will be described more fully hereinafter. The pressure rod 42 also serves as a concentrator, focusing the pressure with essentially line contact. Rotation of the rod 42 is permitted to facilitate movement of the web and other materials in the longitudinal direction defined by the film strips.

First and second film drives 22 and 24 are hidirectional and serve several functions. First they rotate in the same or forward direction to advance the film strips 12 and 14 into position with the splice 10 between the platen 18 and hot shoe 32. Later, after the splice adhesive is softened, the first and second drives are rotated to pull the two film strips apart in opposite directions, separating the strips from the splice. A pulling force starting at approximately three kilo-grams (3 kg) is preferred. Finally, the drives 22 and 24 are operated in the same direction again to advance both film strips 12 and 14 through the desplicing station for the next operation in the process. Sensors 46, 48 and 50 determine the position of the film strips 12 and 14 at various times in the cycle for assisting in the control of the apparatus.

Figure 9:
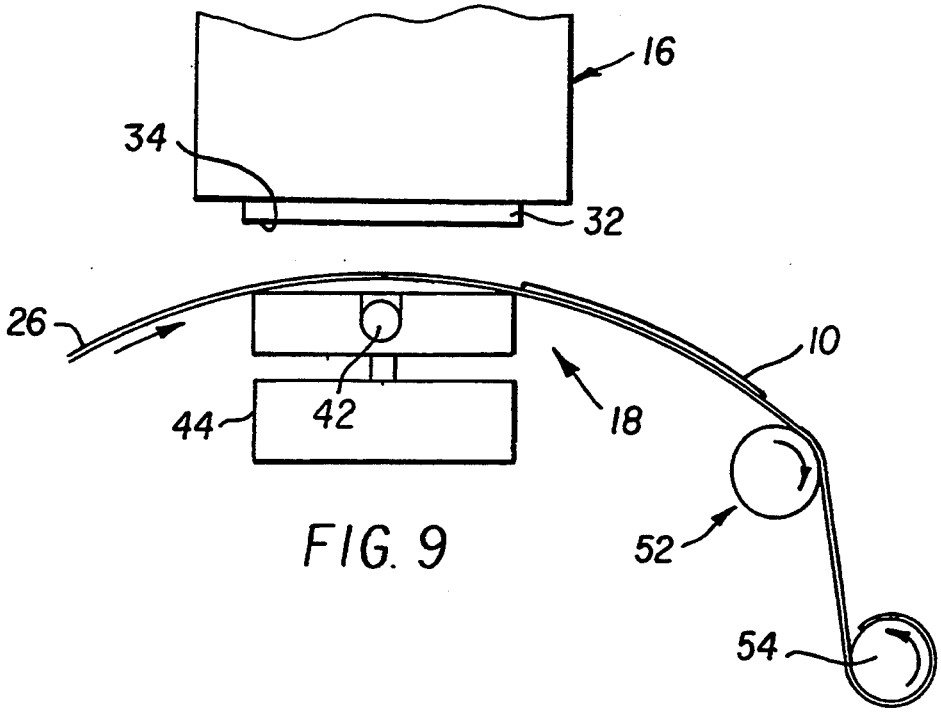

Pick-up web 26 is guided by the platen 18 to lie under the splice 10 above the pressure rod 42. The web 26 is advanced incrementally by a drive 52 (FIGS. 4 and 9) and is wound into a roll 54 (FIG. 9), for capturing the removed splices as they are removed from the film strips.

Figure 5:
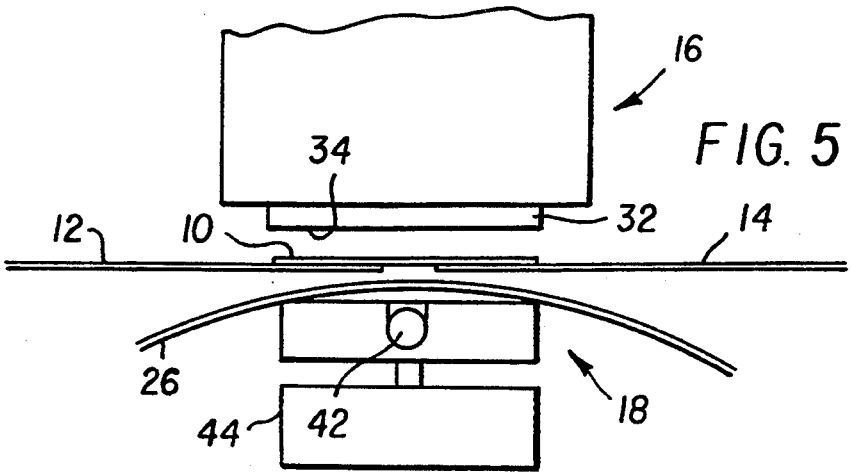
FIGS. 5–9 are schematic views of the apparatus of FIG. 4, and a method, depicting the operational steps involved in removing a splice according to the preferred embodiment.
Figure 6:
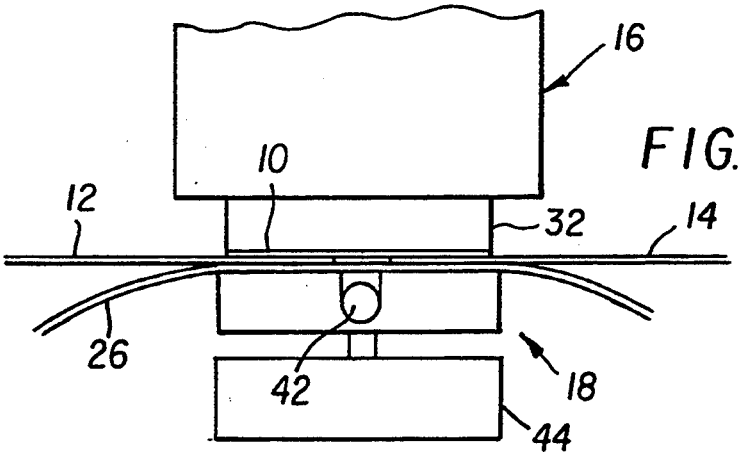
Figure 7:
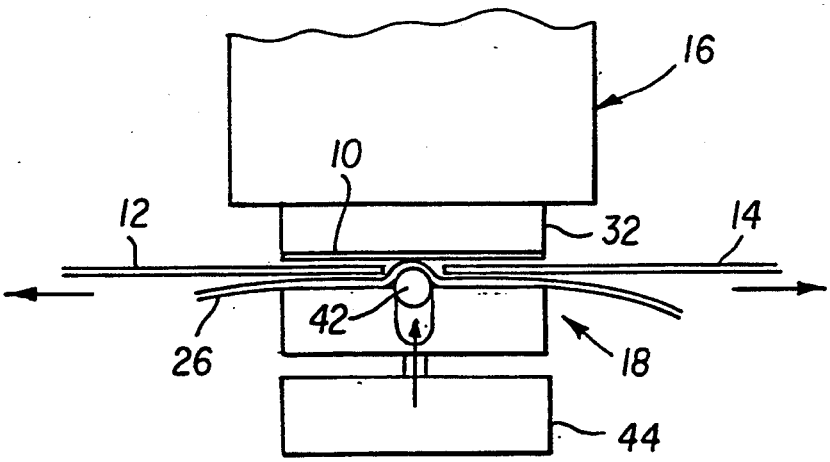
Figure 8:
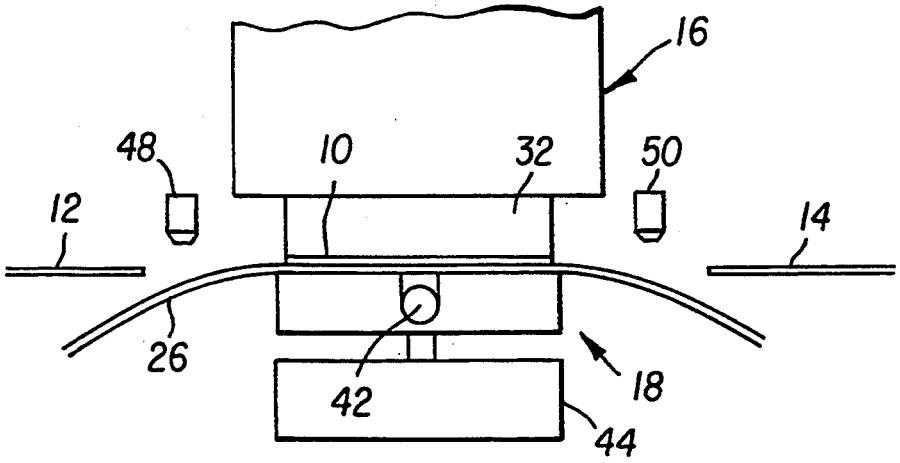

Referring now to FIGS. 5–9, and to the method of operation, spliced film strips 12 and 14 are advanced into the position depicted in FIG. 5, with the splice 10 between the hot plate 34 and the platen 18. The hot plate 34 is then moved into engagement with the splice 10, under pressure, to conductively heat the splice adhesive until it softens (FIG. 6). Typical temperatures are above one hundred and twenty degrees centigrade (120° C.) for a time period between one and several seconds. After the adhesive is softened, the pressure rod 42 is actuated as depicted in FIG. 7 to engage the splice 10 through web 26 and in the space between the film strips. The pressure rod is applied with enough force to raise the hot plate slightly and thereby release some of the pressure exerted on the film strips 12 and 14 by shoe 32. At the same time, the rod 42 captures the splice 10 against the hot plate 34. The film strips 12 and 14 are then pulled apart, as depicted in FIG. 7, to separate the strips from the splice and each other. The pressure rod 42 and hot plate 34 are then lowered again (FIG. 8) to tack the splice to web 26, and the web is advanced (FIG. 9) to remove the splice from the area. Eventually, numerous splices will be wound into a roll 54 convenient for disposal.

After displicing, as described above, film strip 14 is advanced through the desplicing apparatus for further operations at subsequent stations. Film strip 12 is still spliced at its opposite end to yet another film strip, not shown. The operation is repeated at the opposite end of film strip 12, and subsequent film strips, one after another.

Figure 3:
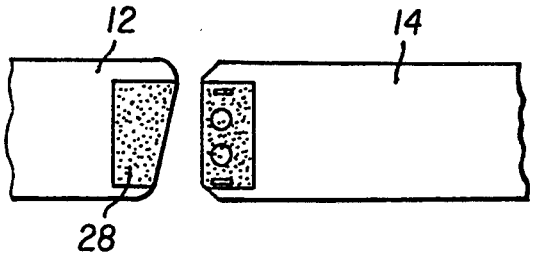
Figure 4:
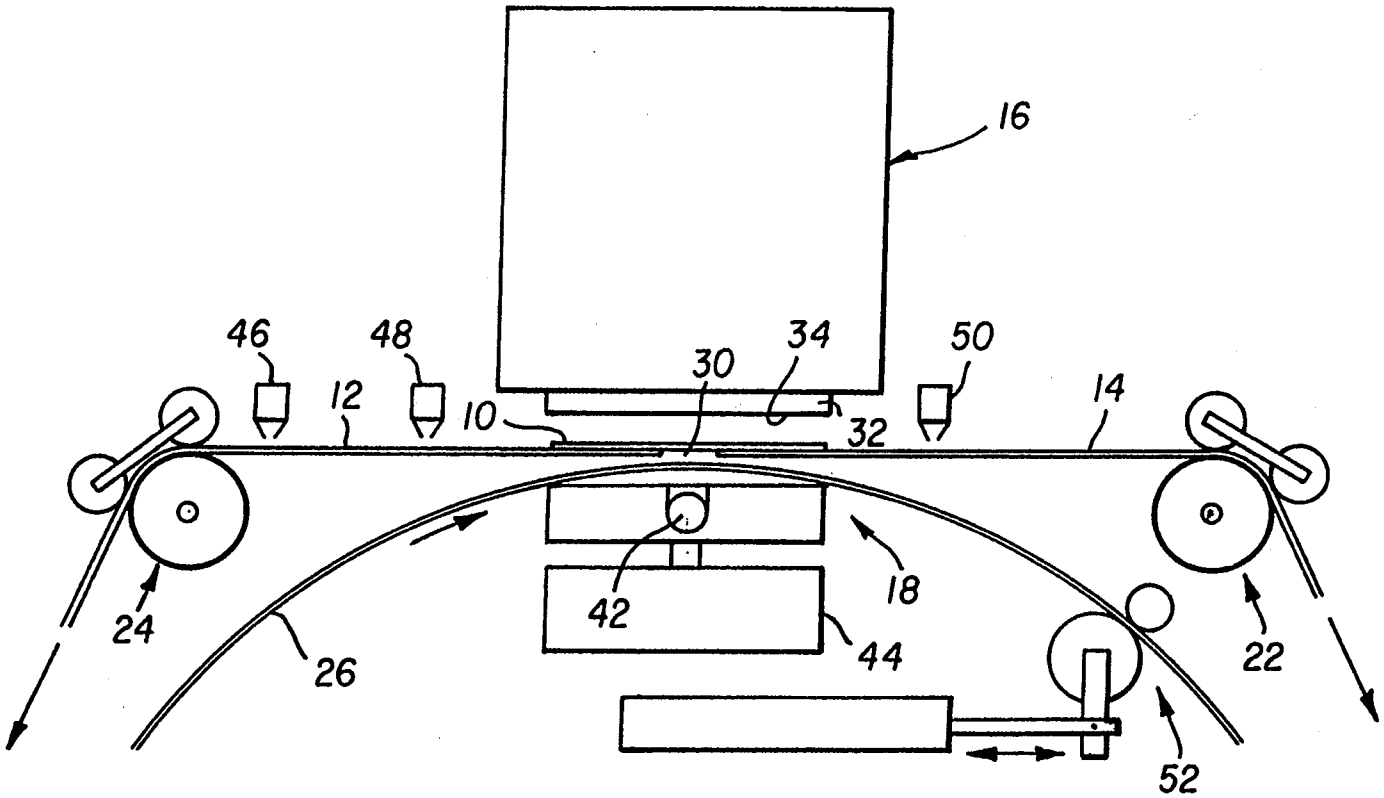
FIG. 4 is a schematic view of the desplicing apparatus of FIG. 1, including additional elements for capturing the splice against the shoe and first and second drives for pulling the film strips in opposite directions to remove the strips from the splice.

FIG. 3 depicts the two film strips after desplicing. Although some adhesive residue 28 may remain, the film strips are intact, retaining their original configuration from the time of manufacture. No cutting is required.

While the invention has been described with particular reference to a preferred embodiment, it will be understood by those skilled in the art that various modifications and substitutions may be made without departing from invention. It is accordingly intended that the claims shall cover all such modifications and substitutions that do not depart from the true spirit and scope of the invention.

PARTS LIST FOR FIGURES

| Reference No. | Part |
|---|---|
| 10. Splice. | |
| 12. Film strip. | |
| 14. Film strip. | |
| 16. Heating head. | |
| 18. Platen. | |
| 22. First drive. | |
| 24. Second drive. | |
| 26. Disposable web. | |
| 28. Thermal adhesive. | |
| 30. Space between film strips. | |
| 32. Heating shoe. | |
| 34. Hot plate. | |
| 36. Ball. | |
| 38. Socket. | |
| 40. Ramp. | |
| 42. Pressure rod. | |
| 44. Air supply. | |
| 46. Sensor. | |
| 48. Sensor. | |
| 50. Sensor. | |
| 52. Drive. | |
| 54. Roll. | |

What is claimed is:

1. Apparatus for separating photographic film strips adhered to a splice; said apparatus comprising:

means for restricting movement of the splice; and, means for pulling the film strips longitudinally in opposite directions to separate the film strips from the splice.

2. Apparatus for separating longitudinal film strips adhered with thermoplastic material; said apparatus comprising:

means for heating the thermoplastic material to soften the material; and, means for pulling the film strips apart longitudinally to separate the film strips.

3. The invention of claim 2, wherein the film strips are adhered to a splice, said apparatus includes means for restricting movement of the splice, and said pulling means separates the film strips from the splice.

4. The invention of claim 3, wherein said heating means is a hot shoe that engages the splice and conductively heats the thermoplastic material.

5. The invention of claim 4, wherein said hot shoe and said restricting means are relatively moveable perpendicular to the longitudinal direction for capturing the splice against said hot shoe.

6. The invention of claim 5, wherein said restricting means is an elongate rod and applies pressure against said shoe along a narrow line of engagement.

7. The invention of claim 6, wherein said rod is supported for rotation.

8. Apparatus for separating first and second photographic film strips adhered with an adhesive to a common splice, the film strips having a space between the film strips at the splice; said apparatus comprising:

means for softening the adhesive;

means for engaging and holding the splice in the space between the film strips; and, means engaging the first and second film strips for moving the film strips apart to separate the film strips.

9. Apparatus for separating photographic film strips adhered with temperature sensitive adhesive to a common splice; said apparatus comprising:

a hot plate for engaging the splice and conductively heating the adhesive;

a platen for capturing the splice against the hot plate with pressure;

a drive for pulling the film strips apart to separate the film strips from the splice.

10. The invention according to claim 9, wherein the film strips define a space between the strips at the splice, and including a pressure member for concentrating pressure in the space between the film strips.

11. The invention according to claim 10, wherein said pressure member is supported by said platen for independent movement relative to said platen.

12. A desplicer for separating photographic film strips adhered with thermoplastic material to a common splice; said apparatus comprising:

a hot shoe for engaging the splice and heating the splice to soften the adhesive;

a platen for pressing the splice against the hot plate to transfer heat to the splice;

a carrier web supported between said hot shoe and said platen for engaging the splice opposite the shoe; and, a drive for pulling the film strips apart to separate the film strips from the splice with the splice engaging the carrier web.

13. The invention of claim 12, wherein the film strips define a space between the strips at the splice, and wherein said platen captures said web against the splice in the space between the strips to adhere the splice to said web.

14. The invention of claim 13, wherein said platen includes a pressure mender for engaging the splice in the space between the film strips.

15. The invention of claim 14, wherein said hot shoe and said platen are supported for relative movement toward and away from each other, and wherein at least one of said shoe and said platen is supported to float for aligning said shoe and said platen when said shoe and said platen move toward each other.

16. A desplicer for separating photographic film strips from a common splice; said desplicer comprising:

a heated plate and a substantially parallel opposed platen supported for relative movement toward and away from each other;

a carrier web supported between said plate and said platen for engaging the splice opposite said plate; and, a film drive first for moving the film strips between said plate and said platen with the splice positioned for heating by said plate, and then for pulling the film strips apart to separate the film strips from the splice with the splice engaging said web;

a web drive for incrementally advancing said web to move the separated splice from between said plate and said platen; and, means for moving said plate and said platen together and then apart once to heat the splice and again to adhere the splice to said web.

17. A method for separating photographic film strips adhered to a splice; said method comprising the steps of:

heating the splice to soften the thermoplastic;

restricting longitudinal movement of the splice; and, pulling the film strips longitudinally in opposite directions to separate the film strips from the splice.

18. A method for separating photographic film strips adhered with a thermal adhesive to a common splice; said method comprising the steps of:

heating the splice to soften the adhesive;

engaging the splice with a carrier web; and, pulling the film strips apart with the splice remaining on the web.

* * * * *

UNITED STATES PATENT AND TRADEMARK OFFICE
CERTIFICATE OF CORRECTION

PATENT NO.: 5,373,339
DATED : December 13, 1994
INVENTOR(S): Greene et al.

It is certified that error appears in the above-identified patent, and that said Letters Patent is hereby corrected as shown below:

Column 6, line 30, after "pressure" delete "mender" and insert --member--.

Signed and Sealed this

Thirteenth Day of June, 1995

*Attest:*

*Attesting Officer*

BRUCE LEHMAN

*Commissioner of Patents and Trademarks*